US005098738A

United States Patent [19]

Nakajima et al.

[11] Patent Number: 5,098,738

[45] Date of Patent: Mar. 24, 1992

[54] HEAT SENSITIVE RECORDING MATERIAL

[75] Inventors: Toshimitsu Nakajima; Shigetoshi Hiraishi, both of Tokyo, Japan

[73] Assignees: Asahi Kasei Kogyo Kabushiki Kaisha, Osaka; Mitsubishi Paper Mills Limited, Tokyo, both of Japan

[21] Appl. No.: 495,766

[22] Filed: Mar. 19, 1990

[51] Int. Cl.[5] ..... B41M 3/12

[52] U.S. Cl. ..... 427/150; 427/151; 427/152

[58] Field of Search ..... 427/150–152

[56] References Cited

U.S. PATENT DOCUMENTS

| | | | |
|---|---|---|---|
| 4,824,824 | 4/1989 | Matsushita et al. | 427/152 |
| 4,880,767 | 11/1989 | Hirashi et al. | 427/150 |
| 4,889,786 | 12/1989 | Takahashi | 427/150 |

FOREIGN PATENT DOCUMENTS

| | | |
|---|---|---|
| 0101741 | 2/1983 | European Pat. Off. . |
| 145231 | 3/1977 | Japan . |

*Primary Examiner*—Janyce Bell

*Attorney, Agent, or Firm*—Cushman, Darby and Cushman

[57] ABSTRACT

A process for producing a heat-sensitive recording material superior in the stability of both base surface and recorded image, characterized by adjusting pH of a heat-sensitive coating suspension of 5 to 12.

10 Claims, No Drawings

HEAT SENSITIVE RECORDING MATERIAL

BACKGROUND OF THE INVENTION

1. Field of the Invention

The present invention relates to method of producing a heat-sensitive recording material which is superior in stability of the base surface of a recording material and stability of an image recorded thereon.

2. Related Art

Recently the use of heat-sensitive recording materials which can record images by using heat energy has been growing in various fields such as facsimile, printers, recorders, typewriters, label printers, automatic vending machines for tickets, etc.

Such heat-sensitive recording materials which comprise electron-donating colorless dye precursors and electron-accepting color developers, have various superior properties including good appearance, good touch feel, high color density and various hues, but they suffer from the problems that if a colored portion (recorded image portion) contacts with plastics such as vinyl chloride, the portion disappears due to plasticizers or additives contained in the plastics, or if the portion contacts with chemicals contained in foods or cosmetics, it easily disappears or it is readily discolored upon exposure to the sun for a few hours, namely they have a defect of poor stability of recorded images.

As heat-sensitive recording materials which can give recorded images having good stability by the reaction of two components upon heating, Japanese Patent Kokai Nos. 58-38733, 58-54085, 58-104959, etc. disclose heat-sensitive recording materials prepared by using an isocyanate compound and an imino-compound as the two components.

These heat-sensitive recording materials having a heat-sensitive layer which is formed of an isocyanate compound and an imino-compound is superior in stability of the recorded image but they have defects in basic stabilities such as yellowing and fogging of non-recorded portions of the base.

OBJECT AND SUMMARY OF THE INVENTION

The object of the present invention is to offer a method of production of a heat-sensitive recording material which has superior stability of the recording material and good stability of recorded images.

As a result of the inventors' intensive research conducted for obtaining a heat-sensitive recording material which has superior base of the recording material and good of recorded images, it was found that the object was achieved by regulating the pH of the heat-sensitive coating liquid to be 5 to 12 when forming the heat-sensitive recording layer, on the substrate, which was composed of an aromatic isocyanate compound and an imino-compound, developing color by the reaction with the aromatic isocyanate compound upon heating. The present invention has been completed based on this finding.

Further it was found that an employment of a neutral paper as the substrate also improved the base stability.

DETAILED DESCRIPTION OF PREFERRED EMBODIMENTS

According to the present invention, the pH of the heat-sensitive coating liquid is 5 to 12, preferably 6 to 12 and more preferably 8 to 12. In addition, use of a neutral paper is more effective, if paper is used as the substrate.

The heat-sensitive coating liquid has an inclination to an occurrence of yellowing and fogging of ground of the heat-sensitive recording material below pH 5, and sometimes reduces the recorded color density above pH 12.

For regulating the pH, acidic or basic compounds are used. These are well-known organo-acidic, inorgano-acidic, organo-basic or inorgano-basic substances. Typical examples of these substances, not limited to these, are shown below:

Organo-acidic substances include acetic acid, acrylic acid, benzoic acid, citric acid, oxalic acid, propionic acid, phthalic acid, formic acid, phenol, p-toluenesulphonic acid, etc.

Inorgano-acidic substances include sulfuric acid, hydrochloric acid, nitric acid, phosphoric acid, boric acid, etc.

Organo-basic substances include aliphatic amines such as monoethanolamine, diethylamine, triethanolamine, pentylamine, etc., guanidine, phenylhydrazine.

Inorgano-basic substances include sodium hydroxide, potassium hydroxide, ammonia, trisodium phosphate, disodium phosphate, borax, calcium metaborate, sodium carbonate, aluminum silicate, magnesium oxide, magnesium carbonate, calcium carbonate, calcium silicate, aluminum hydroxide, ammonum carbonate, etc.

The aromatic isocyanate compound used in the present invention denotes colorless or hypochronic aromatic or heterocyclic isocyanate compound which is solid at ambient temperatures. One or more compounds selected from the following examples are used:

2,6-dichlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5 diethoxybenzene-1,4-diisocyanate, 2,5-dibutoxybenzene-1,4-diisocyanate, azobenzene-4,4'-diisocyanate, diphenylether-4,4'-diisocyanate, naphthalene-1,4-diisocyanate, naphthalene-1,5-diisocyanate, naphthlene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4''-triisocyanate-2,5-dimethoxytriphnylamine, p-dimethylaminophenyl isocyanate, and tris(4-phenylisocyanato) thiophosphate. If necessary, these isocyanates may be used in the form of so-called blocked isocyanates which are addition compounds with phenols, lactams, oximes, etc. and furthermore may be used in the form of dimers of diisocyanates such as dimer of 1-methylbenzene-2,4-diisocyanate and in the form of trimers such as isocyanurates. Besides, they may be used as polyisocyanates aducted with various polyols.

The imino-compounds used in the present invention have at least one $>C{=}NH$ group and are represented by the general formula $\Phi C{=}NH$ =NH (where Φ denotes residual group of aromatic compound, capable of forming a conjugated system with adjacent C=N). And the imino-compounds are colorless or hyperchromic, and solid at normal temperature. Typical examples thereof are shown below. Two or more imino-compounds selected from these compounds can be used in combination according to the purpose.

3-iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercapto-isoindolin-1-one, 3-imino-6-nitroisoindolin-1-one, 3-imino-isoindolin-1-spiro-dioxolan, 1,1-dimethoxy-3-imino-isoindoline, 1,1-diethoxy-3-imino-4,5,6,7-tetrachloroisoindoline, 1-ethoxy-3-imino-isoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4b]pyrazine, 7-amino-2,3-diphenyl-5-oxopyrrolo[3,4b]pyrazine, 7-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4' -nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrozone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6 -dimethyl-4,7-pyradiisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)-carbamoylmethylene]-3-iminoisoindoline, 1-[cyano-N-(4'-chlorophenyl)-carbamoylmethylene]-3-iminoisoindoline, 1-[cyano-N-(4'-methoxyphenyl)carbamoylmethylene]-3-iminoisoindoline, 1-[cyano-N-(3'-chloro-4'-methylphenyl)-carbamoylmethylene]-3 iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzimidazolyl-2')-methylene]-3-imino-6-chloroisoindoline, 1-[(1'-phenyl-3'-methyl-5-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyradiisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide,3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, and 3-imino-2-methyl-4,5,6,7-tetrachloroisoindoline-1-one.

The heat sensitive recording material of the present invention comprises a support and, provided thereon, a heat sensitive recording layer which forms colour upon heating as mentioned above. As the support, paper is mainly used, but various non-woven fabrics, synthetic resin films, laminated papers, synthetic papers, metal foils and composite sheets comprising combinations of them may be used depending on use.

However, when a coating liquid is applied on a substrate, it may be possible that the pH of the applied coating liquid changes depending on the pH of the substrate, so it is preferable that the pH of the coating liquid is close to that of the substrate. The measurement of pH can be carried out according to the method prescribed in JIS-P-8133. When paper is used as the substrate, it is desirable to employ a so-called neutral paper, which is manufactured without auxiliary sizing such as aluminum sulfate, aluminum chloride which is used in the usual paper. The neutral paper can be manufactured by any of the methods of:(a) fixing the sizing agent by itself on fibre of pulp, to offer a sizing effect, like cationic sizing agent; (b) using a cationic high molecular compound as fixing agent; (c) subjecting paper manufactured without incorporating a sizing agent to surface treatment such as size pressing.

Both a single layer structure and a multi-layer structure are available for the heat-sensitive recording layer.

For the multi-layer structure, an inter-layer may be provided between layers. Furthermore, a protection layer may be provided on the heat-sensitive recording layer. This recording layer can be prepared by coating a mixture of an aqueous dispersion obtained by pulverizing each coloring component and a binder on a substrate, and drying the coat. In this case, the multi-layer structure may be formed by adding a different coloring component to each layer.

The heat-sensitive recording material defined by the present invention may contain a heat-fusible substance to improve heat responsibility. In this case, the substance preferably has a melting point of 60° to 180° C., more preferably 80° to 140° C.

As examples of the heat-fusible substance, the following can be given:

benzyl p-benzyloxybenzoate, stearic acid amide, palmitic acid amide, N-methylolstearic acid amide, β-naphthylbenzyl ether, N-stearylurea, N,N'-distearylurea, phenyl β-naphthoate, phenyl 1-hydroxy-2-naphthoate, β-naphthol (p-methylbenzyl) ether, 1,4-dimethoxynaphthalene, 1-methoxy-4-benzyloxy-naphthalene, N-stearoylurea, 4-benzylbiphenyl, 1,2-di(m-methylphenoxy)ethane, 1-phenoxy-2-(4-chlorophenoxy)-ethane, 1,4-butanediolphenyl ether, and dimethyl terephthalate.

The heat-fusible substance may be used alone or in combination with two or more, and is preferably used, to secure a sufficient heat responsibility, in an amount of 10 to 300%, more preferably 20 to 250% by weight of the aromatic isocyanate compound.

The heat-sensitive recording material defined in the present invention can further contain aniline derivatives having at least an amino-group which is disclosed in the Inventors' International Patent Application PCT/JP81/00300. They are more effective for preventing the ground of the recording material from fogging.

Examples of these compounds are given below: methyl p-aminobenzoate, ethyl p-aminobenzoate, n-propyl p-aminobenzoate, iso-propyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)-carbamoyl]aniline, p-[N-(4-aminophenyl)carbamoyl]aniline, 2-methoxy-5-(N-phenylcarbamoyl)aniline, 2-methoxy-5-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-methylaniline, bis[4-(m-aminophenoxy)phenyl]sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolidinesulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4-diaminobiphenyl, 2,2'-dimetyl-4,4'-diaminobiphenyl, 4,4'-dithioaniline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminobiphenylmethane, 3,4'-diaminophenylmethane, bis(3-amino-4-chlorophenyl)-sulfone, bis(3,4-diaminophenyl)sulfone, bis(4-aminophenyl)sulfone, bis(3-aminophenyl)sulfone, 3,4'-diaminodiphenylsulfone, 3,3-diaminodiphenylmethane, 4,4'-ethylenedianiline, 4,4'-diamino-2,2'-dimethylbibenzyl, 4,4'-diamino-3,3'-dichlorodiphenylmethane, 3,3'-diaminobenzophenone, 4,4'-diaminobenzophenone, 1,4-bis(aminophenoxy)benzene, 1,3-bis(4-aminophenoxy)-benzene, 1,3-bis(3-aminophenoxy)benzene, 9-bis(4-aminophenyl)fluorene, 2,2-bis(4-aminophenoxyphenyl)-propane, 4,4'-bis(4-aminophenoxy)diphenyl, 3,3',4,4'-tetraaminodiphenyl ether, 3,3',4,4'-tetraaminodiphenylsulfone, and 3,3',4,4'-tetraaminobenzophenone.

Binders used in the heat-sensitive recording material defined by the present invention include: water-soluble binders such as starches, hydroxyethyl cellulose, methyl cellulose, carboxymethyl cellulose, gelatin, casein, polyvinyl alcohol, modified polyvinyl alcohol, styrene-maleic anhydride copolymer, and ethylene-maleic anhydride copolymer, and latex type water-insoluble binders such as styrene-butadiene copolymer, acrylonitrile-butadiene copolymer and methyl acrylate-butadiene copolymer.

The heat-sensitive layer may further contain pigment such as diatomaceous earth, talc, kaolin, calcined kaolin, calcium carbonate, magnesium carbonate, titanium oxide, zinc oxide, silicon oxide, aluminum oxide, urea-formalin resin, etc. Besides the heat-sensitive layer also may contain a metal salt of higher fatty acid such as zinc stearate, calcium stearate, etc. and wax such as paraffin, oxidised paraffin, polyethylene, oxidised polyethylene, stearic acid amide, castor wax, etc. for the purpose of preventing wear and sticking of a thermal head, and furthermore dispersant, e.g. sodium dioctyl succinate, ultraviolet-absorbing agent of such as benzophenone type, benzotriazole type, etc., surfactant and fluorescent dye.

EXAMPLES

The present invention will be explained in more detail by the following examples.

EXAMPLE 1

(A-suspension)

| | |
|---|---|
| 1,3-diimino-4,5,6,7-tetrachloroisoindoline | 10 g |
| Aqueous solution of 10% polyvinyl alcohol | 5 g |
| Water | 10 g |

This composition was thoroughly dispersed by mixing said materials in a ball mill for 24 hours.

(B-suspension)

| | |
|---|---|
| 4,4',4''-triisocyanate-2,5-dimethoxy-triphenylamine | 10 g |
| Aqueous solution of 10% polyvinyl alcohol | 5 g |

-continued

| | |
|---|---|
| Water | 10 g |

This composition was thoroughly dispersed by mixing said materials in a ball mill for 24 hours.

(C-suspension)

| | |
|---|---|
| 2-methoxy-5-N,N-diethylsulfamoylaniline | 10 g |
| Aqueous solution of 10% polyvinyl alcohol | 5 g |
| Water | 10 g |

This composition was thoroughly dispersed by mixing said materials in a ball mill for 24 hours.

(D-suspension)

| | |
|---|---|
| p-benzylphenyl | 10 g |
| Aqueous solution of 10% polyvinyl alcohol | 5 g |
| Water | 10 g |

This composition was thoroughly dispersed by mixing said materials in a ball mill for 24 hours. A heat-sensitive coating suspension was obtained through the steps consisting of:

(1) mixing the four compositions given above, at a rate of 1.5 parts of A-suspension, 1.0 part of B-suspension, 1.5 parts of C-suspension, 1.5 parts of D-suspension by weight, then (2) adding 9.0 parts by weight of a 50% Kaolin dispersion to the mixture obtained in (a), further (3) adding 1.5 parts by weight of a 40% zinc stearate dispersion, 3.2 parts by weight of aqueous solution of 10% polyvinyl alcohol and 26.6 g of water, and finally (4) sufficiently stirring the resultant suspension.

The heat-sensitive coating suspension thus obtained was adjusted to pH 5.6 by adding aqueous solution of 1N—$H_2SO_4$ thereto.

This coating suspension was coated on acidic paper (pH 3.8) having a base weight of 45 g/m$^2$ or neutral paper (pH 8.9) of 50 g/m$^2$ at the rate of 7.7 g/m$^2$ in terms of solid weight, respectively. Then the coated paper was dried and supercalendered to obtain a heat-sensitive recording material.

EXAMPLE 2

The heat-sensitive coating suspension obtained in Example 1 was adjusted to pH 6.5 by using aqueous solution of 1N—$H_2SO_4$. Otherwise in the same manner as in Example 1, a heat-sensitive recording material was produced.

EXAMPLE 3

A superior heat-sensitive coating suspension obtained in Example 1 was adjusted to pH 5.6 by using aqueous solution of 1N—HCl instead of 1N—$H_2SO_4$. A heat-sensitive recording material was made in the same manner as in Example 1 except the condition given above.

EXAMPLE 4

A superior heat-sensitive coating suspension obtained in Example 1 was adjusted to pH 6.9 by using an aqueous solution of 1N—HCl instead of 1N—$H_2SO_4$. A heat-sensitive recording material was obtained in the same manner as in Example 1 except the condition given above.

EXAMPLE 5

The heat-sensitive coating suspension obtained in Example 1 was adjusted to pH 8.1 by using aqueous solution of 1N—KOH instead of 1N—$H_2SO_4$. A heat-sensitive recording material was obtained in the same manner as in Example 1 except the condition given above.

EXAMPLE 6

The heat-sensitive coating suspension obtained in Example 1 was adjusted to pH 9.1 by using aqueous solution of 1N—KOH instead of 1N—$H_2SO_4$. Otherwise in the same manner as in Example 1, a heat-sensitive recording material was produced.

EXAMPLE 7

The heat-sensitive coating suspension obtained in Example 1 was adjusted to pH 10.1 by using aqueous solution of 1N—KOH instead of 1N—$H_2SO_4$. Otherwise in the same manner as in Example 1, a heat-sensitive recording material was obtained.

EXAMPLE 8

The heat-sensitive coating suspension obtained in Example 1 was adjusted to pH 11.0 by using aqueous solution of 1N—KOH instead of 1N—$H_2SO_4$. A heat-sensitive recording material was made in the same manner as in Example 1 except the condition given above.

EXAMPLE 9

The heat-sensitive coating suspension obtained in Example 1 was adjusted to pH 12.0 by using aqueous solution of 1N—KOH instead of 1N—$H_2SO_4$. A heat-sensitive recording material was produced in the same manner as in Example 1 except the condition given above.

EXAMPLE 10

The heat-sensitive coating suspension obtained in Example 1 was adjusted to pH 8.1 by using aqueous solution of 1N—KOH instead of 1N—$H_2SO_4$. Otherwise in the same manner as in Example 1, a heat-sensitive recording material was produced.

EXAMPLE 11

The heat-sensitive coating suspension obtained in Example 1 was adjusted to pH 9.0 by using aqueous solution of 1N—KOH instead of 1N—$H_2SO_4$. Otherwise in the same manner as in Example 1, a heat-sensitive recording material was produced.

EXAMPLE 12

The heat-sensitive coating suspension obtained in Example 1 was adjusted to pH 10.0 by using aqueous solution of 1N—KOH instead of 1N—$H_2SO_4$. A heat-sensitive recording material was produced in the same manner as in Example 1 except the condition given above.

EXAMPLE 13

The heat-sensitive coating suspension obtained in Example 1 was adjusted to pH 11.0 by using aqueous solution of 1N—KOH instead of 1N—$H_2SO_4$. A heat-sensitive recording material was obtained in the same manner as in Example 1 except the condition given above.

EXAMPLE 14

The heat-sensitive coating suspension obtained in Example 1 was adjusted to pH 12.0 by using aqueous solution of 1N—KOH instead of 1N—$H_2SO_4$. A heat-sensitive recording material was produced in the same manner as in Example 1 except the condition given above.

COMPARATIVE EXAMPLE 1

The heat-sensitive coating suspension obtained in Example 1 was adjusted to pH 2.0 by using aqueous solution of 1N—$H_2SO_4$. Otherwise in the same manner as in Example 1, a heat-sensitive recording material was obtained.

COMPARATIVE EXAMPLE 2

The heat-sensitive coating suspension obtained in Example 1 was adjusted to pH 4.0 by using aqueous solution of 1N—$H_2SO_4$. Otherwise in the same manner as in Example 1, a heat-sensitive recording material was produced.

COMPARATIVE EXAMPLE 3

The heat-sensitive coating suspension obtained in Example 1 was adjusted to pH 1.9 by using aqueous solution of 1N—HCl instead of 1N—$H_2SO_4$. A heat-sensitive recording material was produced in the same manner as in Example 1 except the condition given above.

COMPARATIVE EXAMPLE 4

The heat-sensitive coating suspension obtained in Example 1 was adjusted to pH 3.1 by using aqueous solution of 1N—HCl instead of 1N—$H_2SO_4$. A heat-sensitive recording material was obtained in the same manner as in Example 1 except the condition given above. Test 1 (Color Density)

The heat-sensitive recording materials obtained in Examples 1 to 14 and Comparative examples 1 to 4 were respectively printed by a heat-sensitive facsimile printing tester under the condition of an impressed pulse of 1.4 milli second, and impressed voltage of 11.00 volt. Color densities of the obtained color images were measured by using the Macbeth RD918 densitometer. The results for the acidic paper substrate are shown in Table 1, and those for the neutral paper substrate in Table 2.

Test 2 (Stability)

The heat-sensitive recording materials obtained in Examples 1 to 14 and Comparative examples 1 to 4 were respectively kept in an atmosphere of 60° C. for 18 hours. The densities in the non-recorded portion of base were measured before and after Test 2, and the measured value differences between before Test 2 and after are also shown in Table 1 and 2. The smaller value differences indicate less yellowing and less fogging of the base, and this is a favorable state.

The process for producing the heat-sensitive recording material which is superior in the stability or recorded image and of the base of the recording material, can be provided by adjusting the heat-sensitive coating suspension which is prepared according to the present invention, to pH 5 to 12.

TABLE 1

| Test 1, 2 | | | Substrate (acidic paper) | |
|---|---|---|---|---|
| | | Coating suspension pH | Color density | Difference in base density |
| Comparative example | 1 | 2.0 | 0.78 | 0.45 |
| Comparative example | 2 | 4.0 | 0.80 | 0.13 |
| Example | 1 | 5.6 | 0.84 | 0.06 |
| Example | 2 | 6.5 | 0.80 | 0.06 |
| Comparative example | 3 | 1.9 | 0.80 | 0.50 |
| Comparative example | 4 | 3.1 | 0.79 | 0.35 |
| Example | 3 | 5.6 | 0.81 | 0.05 |
| Example | 4 | 6.9 | 0.80 | 0.05 |
| Example | 5 | 8.1 | 0.79 | 0.06 |
| Example | 6 | 9.1 | 0.87 | 0.05 |
| Example | 7 | 10.1 | 0.79 | 0.03 |
| Example | 8 | 11.0 | 0.78 | 0.02 |
| Example | 9 | 12.0 | 0.81 | 0.01 |
| Example | 10 | 8.1 | 0.79 | 0.06 |
| Example | 11 | 9.0 | 0.79 | 0.05 |
| Example | 12 | 10.0 | 0.81 | 0.03 |
| Example | 13 | 11.0 | 0.80 | 0.02 |
| Example | 14 | 12.0 | 0.80 | 0.01 |

TABLE 2

| Test 1, 2 | | | Substrate (neutral paper) | |
|---|---|---|---|---|
| | | Coating suspension pH | Color density | Difference in base density |
| Comparative example | 1 | 2.0 | 0.86 | 0.29 |
| Comparative example | 2 | 4.0 | 0.81 | 0.06 |
| Example | 1 | 5.6 | 0.83 | 0.03 |
| Example | 2 | 6.5 | 0.80 | 0.02 |
| Comparative example | 3 | 1.9 | 0.83 | 0.28 |
| Comparative example | 4 | 3.1 | 0.82 | 0.11 |
| Example | 3 | 5.6 | 0.76 | 0.02 |
| Example | 4 | 6.9 | 0.80 | 0.03 |
| Example | 5 | 8.1 | 0.82 | 0.03 |
| Example | 6 | 9.1 | 0.78 | 0.02 |
| Example | 7 | 10.1 | 0.79 | 0.00 |
| Example | 8 | 11.0 | 0.78 | 0.01 |
| Example | 9 | 12.0 | 0.81 | 0.01 |
| Example | 10 | 8.1 | 0.82 | 0.03 |
| Example | 11 | 9.0 | 0.80 | 0.03 |
| Example | 12 | 10.0 | 0.81 | 0.02 |
| Example | 13 | 11.0 | 0.76 | 0.01 |
| Example | 14 | 12.0 | 0.79 | 0.01 |

What is claimed is:

1. A process for producing a heat-sensitive recording material, comprising:
   a) forming a heat-sensitive coating suspension comprising an aromatic isocyanate compound and an imino-compound capable of developing color by the reaction therebetween on heating;
   b) adjusting the pH of the suspension to pH 5 to 12 by the addition of a compound selected from the group consisting of inorganic acids and basic compounds; and
   c) coating said suspension on a suitable substrate.

2. A process for producing a heat-sensitive recording material according to claim 1, wherein the substrate is neutral paper.

3. A process for producing a heat sensitive recording material according to claim 1, wherein pH of the suspension is adjusted by an inorganic acid.

4. A process for producing a heat sensitive recording material according the claim 3, wherein the inorganic acid is selected from sulfuric acid, hydrochloric acid, nitric acid, phosphoric acid, and boric acid.

5. A process for producing a heat-sensitive recording material according to claim 1, wherein the basic compound is an organic base.

6. A process for producing a heat-sensitive recording material according to claim 5, wherein the organic base is selected from the group consisting of monoethanolamine, diethylamine, triethanolamine, pentylamine, triethylamine, guanidine, and phenyl hydrazine.

7. A process for producing a heat sensitive recording material according to claim 1, wherein the basic compound is an inorganic base.

8. A process for producing a heat sensitive recording material according to claim 7, wherein the inorganic base is selected from sodium hydroxide, potassium hydroxide, ammonia, trisodium phosphate, disodium phosphate, borax, calcium metaborate, sodium carbonate, aluminum silicate, magnesium oxide, magnesium carbonate, calcium silicate, and ammonium carbonate.

9. A process for producing a heat sensitive recording material according to claim 1, wherein the pH of the suspension is adjusted to be in the range 6 to 12.

10. A process for producing a heat sensitive recording material according to claim 1, wherein the pH of the suspension is adjusted to be in the range 8 to 12.

* * * * *